US006620777B2

(12) United States Patent
Heibel et al.

(10) Patent No.: US 6,620,777 B2
(45) Date of Patent: Sep. 16, 2003

(54) FABRIC CARE COMPOSITION COMPRISING FABRIC OR SKIN BENEFICIATING INGREDIENT

(75) Inventors: Marija Heibel, Highland Park, NJ (US); Alain Jacques, Blegny (BE); Joseph Reul, Hucsy (BE); Daniel Wayne Smith, Flemington, NJ (US); Karen Drehs, Hillsborough, NJ (US); Amjad Farooq, Somerville, NJ (US)

(73) Assignee: Colgate-Palmolive Co., New York, NY (US)

( * ) Notice: Subject to any disclaimer, the term of this patent is extended or adjusted under 35 U.S.C. 154(b) by 247 days.

(21) Appl. No.: 09/893,117

(22) Filed: Jun. 27, 2001

(65) Prior Publication Data

US 2003/0045447 A1 Mar. 6, 2003

(51) Int. Cl.[7] ..... C11D 3/37; C11D 17/08
(52) U.S. Cl. ..... 510/516; 510/329
(58) Field of Search ..... 510/516, 329, 510/438

(56) References Cited

U.S. PATENT DOCUMENTS

| | | | | | |
|---|---|---|---|---|---|
| 3,415,758 | A | | 12/1968 | Powell et al. | 252/316 |
| 3,516,941 | A | | 6/1970 | Matson | 252/316 |
| 3,576,760 | A | | 4/1971 | Gould et al. | 252/403 |
| 3,870,542 | A | | 3/1975 | Ida et al. | 117/33.3 |
| 4,145,184 | A | * | 3/1979 | Brain et al. | 8/137 |
| 4,209,417 | A | | 6/1980 | Whyte | 252/174.11 |
| 4,234,627 | A | * | 11/1980 | Schilling | 427/242 |
| 4,339,356 | A | | 7/1982 | Whyte | 252/522 |
| 4,464,271 | A | | 8/1984 | Munteanu et al. | 252/8.6 |
| 4,946,624 | A | * | 8/1990 | Michael | 252/315.2 |
| 4,976,961 | A | | 12/1990 | Norbury et al. | 424/401 |
| 5,112,688 | A | * | 5/1992 | Michael | 428/402.2 |
| 5,137,646 | A | | 8/1992 | Schmidt et al. | 252/8.8 |
| 5,154,842 | A | | 10/1992 | Walley et al. | 252/8.6 |
| 6,042,792 | A | | 3/2000 | Shefer et al. | 422/259 |

* cited by examiner

*Primary Examiner*—John Hardee
(74) *Attorney, Agent, or Firm*—Bernard Lieberman

(57) ABSTRACT

Stable fabric softening compositions are disclosed comprising:

(a) a cationic softening compound;

(b) a non-confined fragrance oil;

(c) at least one fabric or skin beneficiating ingredient free of any water-insoluble polymer or non-polymeric carrier material and which beneficiating ingredient is contained within friable microcapsules comprising an aminoplast polymeric shell with the proviso that when the beneficiating ingredient is a fragrance oil, the fabric softening composition is prepared by adding sequentially or in combination (i) said non-confined fragrance oil of (b); and (ii) the encapsulated fragrance oil of (c) to said cationic softening compound in the absence of any suspending agent; and (d) balance water whereby the ordinary manipulation of fabric during wearing or handling is capable of rupturing the polymeric shell of said microcapsules to release said fabric or skin beneficiating ingredient.

9 Claims, No Drawings

FABRIC CARE COMPOSITION COMPRISING FABRIC OR SKIN BENEFICIATING INGREDIENT

TECHNICAL FIELD

The present invention relates to a fabric care composition, which comprises an encapsulated "fabric or skin beneficiating ingredient". More particularly, this invention relates to fabric softening compositions, such as fabric softeners, fabric refreshers, detergents in a form of liquid, powder, gel or a composition applied onto a fabric substrate such as fabric softener sheets and/or wipes.

All above-mentioned compositions comprise three main ingredients: (a) cationic softening compound; (b) non-confined fragrance oil, (c) at least one fabric or skin beneficiating ingredient free of any water-soluble or water-insoluble polymer or nonpolymeric carrier and contained within pressure sensitive microcapsules. This invention provides enhanced delivery of the fabric or skin beneficiating ingredient to the fabric.

BACKGROUND OF THE INVENTION

The present invention is based on the concept of fragrance, perfume, emollient or other fabric or skin beneficiating ingredient being released "on demand", e.g., release at a time of fabric/clothes use and/or wear.

The concept of controlled active release is known in the art, and various methods for achieving this have been developed. One aspect of the controlled release of perfume, for example, is providing slow release of perfume over an extended period of time. This is generally achieved by blending perfume or other fabric or skin beneficiating ingredient with a substance that will, in essence, "trap" the perfume and subsequently release small amounts of perfume over time.

One of the simplest embodiments consists of putting perfume in wax such as described in Canadian Patent No. 1,111,616 to Young, issued November 1981 and in U.S. Pat. No. 6,042,792 to Shefer et al. issued Mar. 28, 2000. Other embodiments encompass the complex technology of microencapsulation, such as in U.S. Pat. No. 4,464,271 to Munteanu et al. issued Aug. 7, 1984 which describes softener compositions containing a non-confined fragrance oil and a fragrance oil entrapped in solid particles.

An example of such microencapsulation technology is embodied in capsules filled with perfume, which are commercially marketed by, e.g., the Reed Pacific Company in Australia or Euracli Company in France. These capsules are adapted to break under friction and provide an instant "burst" of the fragrance when the capsules are ruptured. Microcapsules of the aminoplast type are used in the textile industry, and especially in so-called "intelligent fabrics" or "smart textiles", such as "Le carre de soie" by Hermes or by DIM (women panties with encapsulated emollient). More particularly, Hermes has commercialized luxurious scarves that release the Hermes perfume by friction created by contact with the neck of the consumer. Dim markets panties which release a relaxing agent for the legs. The microcapsules used are deposited on the fabric surface during the fabric finishing operation which is carried out by the textile manufacturer. These microcapsules are generally removed in the course of subsequent domestic washing; typically capsules can withstand about 5 washes before the fabric or skin beneficiating ingredients lose their intended effect.

From the above, it is clear that the preparation of microcapsules is a known art; preparation methods are, for instance, described in detail in a handbook edited by Simon Benita ("Microencapsulation; Methods and Industrial Applications, Marcel Dekker, Inc. N.Y., 1996), the contents of which are incorporated herein by reference for the preparation techniques described therein.

The preparation process is also the subject of several patents, such as U.S. Pat. No. 3,516,941 to Matson and U.S. Pat. No. 4,976,961 to Norbury and Chang, the disclosures of which are incorporated herein by reference.

Further reference is made to a number of patent publications, which describe the use of encapsulated fragrance in household applications, and more specifically in detergent compositions and in fabric softener products. For example, U.S. Pat. No. 4,145,184 to Brain et al. describes detergent compositions which contain perfumes in the form of friable microcapsules. Preferred materials for the microcapsule shell walls are the aminoplast polymers comprising the reaction product of urea and aldehyde.

U.S. Pat. No. 5,137,646 to Schmidt et al. issued August 1992, describes the preparation and use of perfumed particles, which are stable in fluid compositions and which are designed to break as the perfumed formulation is used, thereby releasing the perfumed particle. More specifically, this patent describes a fabric softener composition comprising one or more fabric- or fiber-softening or antistatic agents, and perfume particles comprising perfume dispersed in a solid core comprising a water-insoluble polymeric carrier material, such as polymers selected from the group consisting of polyethylene, polyamides, polystyrene, polyisoprenes, polycarbonates, polyesters, polyacrylates, vinyl polymers and polyurethanes. These cores are encapsulated by having a friable coating, a preferred coating being an aminoplast polymer which is the reaction product of an amine selected form the group consisting of urea and melamine and an aldehyde selected from the group consisting of formaldehyde, acetaldehyde and glutaraldehyde.

The perfume/controlled release agent may also be in the form of particles mixed into the laundry composition. According to one known method perfume is combined with a water-soluble polymer to form particles which are then added to a laundry composition, as described in U.S. Pat. No. 4,209,417 to Whyte issued June 1980; U.S. Pat. No. 4,339,356 to Whyte issued July 1982; and U.S. Pat. No. 3,576,760 to Gould et al. issued April 1971; and U.S. Pat. No. 5,154,842 to Walley et al. issued October 1992.

The perfume may also be adsorbed onto a porous carrier material, which may be a polymeric material. See, for example, U.S. Pat. No. 5,137,646 to Schmidt et al.

SUMMARY OF THE INVENTION

The present invention provides a stable fabric softening composition comprising:

(a) a cationic softening compound;

(b) a non-confined fragrance oil;

(c) at least one fabric or skin beneficiating ingredient free of any water-insoluble polymer or non-polymeric carrier and which is contained within friable microcapsules comprising an aminoplast polymeric shell, said microcapsules having a diameter of from about 0.1 to about 350 microns, with the proviso that when said fabric beneficiating ingredient is a fragrance oil, said fabric softening composition is prepared by a process comprising the step of adding sequentially or in combination (i) said non-confined fragrance oil of (b); and (ii) the encapsulated fragrance oil of (c) to said cationic softening compound and wherein said non-confined fragrance oil is not mixed with any suspending agent prior to its addition to said cationic softening compound in accordance with said process, whereby the ordinary manipulation of fabric is capable of rupturing the polymeric shell of said microcapsules which are deposited on the fabric surface during treatment with said fabric softening composition to release said fabric or skin beneficiating ingredient.

In a preferred embodiment of the invention the softening composition further includes a nonionic or cationic polymer other than the aminoplast polymer, most preferably a cross-linked cationic polymer to enhance the substantivity and deposition of the fabric or skin beneficiating ingredient on the fabric surface. Particularly preferred cationic polymers for this purpose are derivable from a water soluble cationic ethylenically unsaturated monomer or blend of monomers which is cross-linked by a cross-linking agent comprising polyethylene functions, such as, methylene bisacrylamide. Such cross-linked cationic polymers may also serve to thicken the softening composition. In a less preferred embodiment of the invention non-ionic polymers, such as for example, but not limited to poly(ethylene oxide), non-ionic polyacrylamide, nonionic cellulose ether, modified non-ionic starch polymers, can be used as well.

For purposes of the present invention a "fabric or skin beneficiating ingredient" is any substance which improves or modifies the chemical or physical characteristics of the fabric being treated therewith. Examples of such fabric or skin beneficiating ingredients include perfumes or fragrance oils, elasticity improving agents, vitamins, skin conditioners, antibacterial agents, antistatic agents, enzymes, crease proofing agents, UV absorbers, heat proofing agents and brighteners. The most preferred fabric or skin beneficiating ingredient is perfume. Perfume is an especially suitable fabric or skin beneficiating ingredient for use herein since its volatility generally creates special problems when it is used in conventional fabric treatment compositions, such as, fabric softeners.

The terms "fragrance oil" or "perfume" as used herein refer to any odoriferous material which may be selected according to the desires of the formulator from natural or synthetically produced fragrant substances to impart a desired fragrance. In general, such perfume materials or fragrance oils are characterized by a vapor pressure above atmospheric pressure at ambient temperatures and are ordinarily liquid at ambient temperatures, but may also be solids such as the various camphoraceous perfumes known in the art. A wide variety of chemicals are known for perfumery uses, including blends of various organic compounds such as aldehydes, ketones, esters, and the like. More commonly, naturally-occurring plant and animal oils and exudates comprising complex mixtures of various chemical components are known for use as perfumes, and such materials can be used herein. The perfumes herein can be relatively simple in their composition, or can comprise highly sophisticated, complex mixtures of natural and synthetic chemical components, all chosen to provide a desired fragrance.

The fabric softening compositions described herein may be in the form of a liquid, powder or gel as well as a fabric softener sheet. The liquid form of the composition is generally preferred for domestic automatic washing machine use.

DETAILED DESCRIPTION OF THE INVENTION

The fabric softener compositions of the invention contain at least one fabric or skin beneficiating ingredient agent encapsulated in microcapsules which are used as a delivery vehicle for such ingredient in a domestic laundry operation.

The present compositions prolong the effect provided by encapsulated fabric or skin beneficiating ingredients on the surfaces treated with said compositions. For instance, a longer lasting performance is noted with respect to perfume on dry clothes treated with a fabric softener composition of the invention.

Moreover, the preferred compositions which comprise the cationic cross-linked polymer provide an excellent delivery vehicle for microcapsules on the substrates of treated fabrics.

The microcapsules are made of a hard polymeric material that is friable and which ruptures upon gentle rubbing. In this way, an intense burst of fabric or skin beneficiating ingredient can, for instance, be detected on fabric rinsed with a softener composition of the invention during the ordinary manipulation of the fabric. The perfume, for example, is released at the time the user wears the clothes. Dry towels washed with a fabric softener of the invention have a pleasing fragrance and manifest a particularly intense "fragrance burst" when used.

The compositions of the invention protect the friable microcapsules during product storage prior to use and during use and also maximize the deposition of microcapsules onto fabric surface, so that the majority of capsules in the composition deposit on the fabric. The capsules survive the fabric treatment process undisturbed and, hence, are not ruptured, until the consumer breaks the microcapsules by gentle rubbing during the ordinary manipulation of the fabric during use and wear.

Microcapsules

There are several types of microcapsules differentiated by their chemical nature, and by the encapsulating process. The choice of the type of microcapsules must be made according to the desired properties of the capsules in the contemplated applications. Microcapsules are currently used in the fields of chemistry (printing and recording, in carbon-less paper); food (aromas preservation), medicine and pharmacy (controlled release, target drug delivery) among other applications.

The microcapsules which are useful in the compositions of the present invention must be water insoluble and must be sufficiently stable in the pH range of the softening composition per se as well as in use; for fabric softeners, this means that the microcapsules should be stable at acidic pH's of between 1 and 7. Preferred microcapsules generally have a diameter ranging from about 0.1 to 350 microns and most preferred from about 1 to 10 microns. When applied to the surface to be treated with the composition, the microcapsules should be sufficiently friable to break upon the application of friction such as occurs during ordinary use of the treated fabric. Yet, they should not rupture during the application or treatment step.

Suitable microcapsules are disclosed in and can be prepared as described in the above mentioned U.S. Pat. No. 5,137,646, which document with regard to the process of manufacturing microcapsules is incorporated herein by reference. These capsules are chemically and physically (particle size) compatible with fabric softeners and other liquid surfactant containing aqueous solutions.

Suitable microcapsules which contain a fragrance oil and which are useful in the composition of the present invention are typically in the form of an "encapsulated fragrance slurry", comprising:

a. a non-confined (free) fragrance;

b. an encapsulated fragrance;

c. an encapsulating shell material; and d. water

A general range of composition for an encapsulated fragrance slurry composition is from about 1–50% non-confined (free) fragrance; from about 1–50% encapsulated fragrance; from about 4–20% encapsulating shell material; and balance water.

The preferred encapsulating shell material is a polymeric shell, which is the reaction product of urea and an aldehyde, such as, formaldehyde.

The micro encapsulation principle is relatively simple. A thin polymer shell is created around droplets or particles of an active agent emulsified or dispersed in a carrier liquid. Highly preferred materials for the microcapsule shell wall are the aminoplast polymers comprising the reactive products of urea and aldehyde, e.g. formaldehyde. Such materials are those which are capable of acid condition polymerization from a water-soluble prepolymer state. Such prepolymers are made by reacting urea and formaldehyde in a formaldehyde:urea molar ratio of from about 1.2:1 to 2.6:1. Thiourea, cyanuramide, guanidine, N-alkyl ureas, phenols, sulfonamides, anilines and amines can be included in small amounts as modifiers for the urea. Polymers formed from such prepolymer materials under acid conditions are water-insoluble and can provide the requisite capsule friability characteristics. Microcapsules having the liquid cores and polymer shell walls as described above can be prepared by any conventional process which produces capsules of the requisite size, friability and water-insolubility. Generally, such methods as coacervation and interfacial polymerization can be employed in known manner to produce microcapsules of the desired characteristics. Such methods are described in Ida et al, U.S. Pat. No. 3,870,542, issued Mar. 11, 1975; Powell et al, U.S. Pat. No. 3,415,758, issued Dec. 10, 1968; and Anthony, U.S. Pat. No. 3,041,288, issued Jun. 26, 1962. All of these patents are incorporated herein by reference.

Microcapsules made from the preferred urea-formaldehyde shell materials can be made by an interfacial polymerization process described more fully in Matson, U.S. Pat. No. 3,516,941, issued Jun. 23, 1970, incorporated herein by reference. By that process an aqueous solution of a urea-formaldehyde precondensate (methylol urea) is formed containing from about 3% to 30% by weight of the precondensate. Water-insoluble liquid core material (i.e., perfume) is dispersed throughout this solution in the form of microscopically-sized discrete droplets. While maintaining solution temperature between 20.degree. C. and 90.degree. C., acid is then added to catalyze polymerization of the dissolved urea-aldehyde performance. If the solution is rapidly agitated during this polymerization step, shells of water-insoluble urea-formaldehyde polymer form around and encapsulate the dispersed droplets of liquid core material. Preferred microcapsules for use in the present invention are thereby produced.

The Fabric softener compositions of the invention can comprise any effective amount of the friable microcapsules. By "effective amount" is meant an amount of microcapsules sufficient that the number becoming attached to the fabric during the laundering operation is enough to impart a noticeable odor to the laundered fabric when the fabric is rubbed or scratched.

The final result of the encapsulation is a suspension of microcapsules with a useful size of between about 0.1 to about 350 microns and containing fabric or skin beneficiating ingredient ingredients in a concentration of generally 20 to 90% (by weight). Preferred microcapsules generally have a diameter ranging from about 0.1 to 350 microns and most preferably from about 1 to 10 microns. The wall of the capsules is made out of an encapsulating polymeric shell, which comprises an aminoplast polymer such as described in the aforementioned U.S. Pat. No. 4,145,184.

The term "size" as used herein refers to average particle diameter for substantially spherical particles, or the size of the largest diameter or dimension for nonspherical particles. Particle sizes larger than 350 microns may not have enough surface area to release the encapsulated ingredient at the desired rate. Also, larger particles herein may be undesirably noticeable on the fabric surface being treated. Particles at the low end of the range tend to adhere well to the surface being treated, but may tend to release the encapsulated ingredient too quickly.

The average particle size for encapsulated fragrance in a preferred embodiment is between 0.9 to 10 $\mu$m (measured by Coulter LS230 or Coulter N4 Plus instrument). The surface potential of these capsules is slightly negative: −16.2 mV at 35.2° C.; and −21.7 mV at 26.3° C.

Microcapsules for use herein are free of any non-polymeric carrier material as well as any water-soluble or water-insoluble polymeric carrier material. U.S. Pat. No. 5,137,646 to Schmidt et al. describes the polymeric materials typically employed in the prior art as carriers in conjunction with perfume in a microcapsule. Such polymeric materials broadly include polyethylenes, polyamides, polystyrenes, polyisoprenes, polycarbonates, polyesters, polyacrylates, vinyl polymers and polyurethanes. In U.S. Pat. No. 5,154,842 to Walley et al. various described fatty alcohols and esters are listed as preferred carrier materials. Both the '646 patent and the '842 patent state that the carrier material must allow for diffusion of perfume therethrough.

Absence of Suspending Agent

The free fragrance and encapsulated fragrance oil in the fabric softening compositions of the invention are free of any suspending agent and are not pre-mixed with any such suspending agent prior to addition to the cationic softening compound. Unlike the prior art, the present fabric softening compositions avoid the use of suspending agents being mixed with free or non-combined fragrance and encapsulated fragrance oil prior to adding such fragrance to the cationic softener. Suspending agents in the prior art are described, for example, in U.S. Pat. No. 4,464,271 to Munteanu et al. which use suspending agents to help suspend the free fragrance in a fragrance matrix. Typical suspending agents described in the prior art thus include clay, hydroxypropyl cellulose, silica, xanthan gum, ethyl cellulose, microcrystalline cellulose, carrageenan, propylene glycol alginate, sodium alginate, methyl cellulose, sodium carboxymethyl cellulose; and Veegum (manufactured by R. T. Vanderbilt Company, a natural inorganic complex of colloidal magnesium aluminum silicate.

Nonionic or Cationic Polymer

The cationic cross-linked polymer as described herein is a particularly preferred ingredient and is derivable from a water soluble cationic ethylenically unsaturated monomer or blend of monomers, which is cross-linked by a cross-linking agent comprising polyethylenic functions. Suitable cross-linked cationic polymers are known in the art, and for instance described in U.S. Pat. No. 4,806,345. This patent describes personal care compositions which have as a thickening agent a cross-linked cationic vinyl addition polymer derived from the polymerization of a cationic vinyl addition monomer, acrylamide, and 50–500 ppm of a difunctional vinyl addition monomer for cross-linking purposes.

Also suitable but less preferred polymers are described in WO 90/12862 in the name of British Petroleum. This publication discloses aqueous based fabric conditioning formulations comprising a water dispersible cationic softener and as a thickener a cross-linked cationic polymer that is derivable from a water soluble cationic ethylenically unsaturated monomer or blend of monomers, which is cross-linked by 5 to 45 ppm of a cross-linking agent comprising polyethylenic functions.

A commercially available cationic polymer related to the aforementioned WO 90/12862 is a cross-linked cationic copolymer of about 20% acrylamide and about 80% of trimethylammonioethylmethacrylate salt cross-linked with 5–45 ppm methylene bis acrylamide (MBA). The cross-linked polymer is supplied in a liquid form as an inverse emulsion in mineral oil and is marketed by Honeywill & Stein.

Further, in Research Disclosure, page 136, no. 429116 of January 2000, SNF Floerger describes particular cationic polymeric thickeners that are useful in the softening compositions of the invention. These described thickeners are branched and/or cross-linked cationic polymers formed from monoethylenically unsaturated monomers being either water soluble cationic monomers or blends of cationic monomers that may consist of cationic monomers alone or may comprise a mixture from 50–100% cationic monomer or blend thereof and from 0–50% of non-ionic monomers in the presence of a cross-linking agent in an amount of 60 to 3000 ppm and of chain transfer agent in an amount of between 10 and 2000 ppm. The cationic monomers are selected from the group of dimethylaminopropyl methacrylamide, dimethylaminopropylacrylamide, diallylamine, methyidiallylamine, dialkylaminoalkylacrylate and methacrylate, dialkylaminoalkyl acrylamide or methacrylamide, derivatives of the previously mentioned monomers or quaternary or acid salts thereof. Suitable non-ionic monomers are selected from the group consisting of acrylamide, methacrylamide, N-alkyl acrylamide, N-vinyl pyrrolidone, vinylacetate, vinyl alcohol, acrylate esters, allyl alcohol, and derivatives thereof. The cross-linking agents are methylene bisacrylamide and all diethylenically unsaturated compounds.

Preferably, a cross-linked cationic vinyl polymer is used, derived from the polymerisation of from 5 to 100 mole percent of a cationic vinyl addition monomer, and especially a quaternary ammonium salt of dimethylaminoethyl methacrylate, from 0 to 90 mole percent of acrylamide, and from 70 to 250 ppm, preferably between 75 and 200 ppm and most preferably between 80 and 150 ppm, of a difunctional vinyl addition monomer.

Generally, such polymers are prepared as water-in-oil emulsions, wherein the cross-linked polymers are dispersed in mineral oil, which may contain surfactants. During finished product making, when in contact with the water phase, the emulsion inverts, allowing the water-soluble polymer to swell.

The most preferred cationic polymer for use in the present invention is a cross-linked copolymer of a quaternary ammonium acrylate or methacrylate in combination with an acrylamide comonomer.

Nonionic polymers are also useful for the present invention although less preferred. Examples of such nonionic polymers which can be used include poly(ethylene oxide), non-ionic polyacrylamide, nonionic cellulose ether and modified non-ionic starch polymers.

Cationic Softening Compound

In the compositions of the present invention various types of fabric softeners may be useful which are in the category of cationic, nonionic, and anionic surfactants. In addition, other conventional ingredients for fabric softening and conditioning compositions, such as clays, silicones, fatty alcohols, fatty esters and the like may optionally be added.

The preferred cationic preferred softeners include esterquats, imidazolinium quats, difatty diamido ammonium methyl sulfate, difatty amidoamine and ditallow dimethyl ammonium chloride. Suitable cationic softeners are described in U.S. Pat. No. 5,939,377, U.S. Pat. No. 6,020,304, U.S. Pat. No. 4,830,771, U.S. Pat. No. 5,501,806, and U.S. Pat. No. 4,767,547, all of which disclosures are incorporated herein by reference.

The most preferred softener for use in the present invention is produced by reacting two moles of fatty acid methyl ester with one mole of triethanolamine followed by quaternization with dimethyl sulfate (further details on this preparation method are disclosed in U.S. Pat. No. 3,915,867). The reaction products are distributed as follows: (a) 50% diesterquat material; (b) 20% monoesterquat; and (c) 30% triesterquat.

FIG. 1
Synthesis of Triethanolamine Esterquat

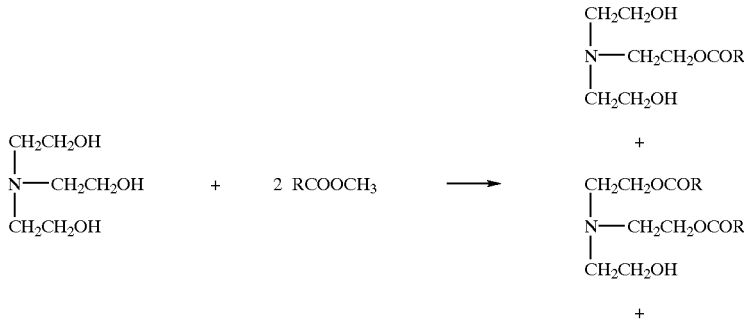

-continued

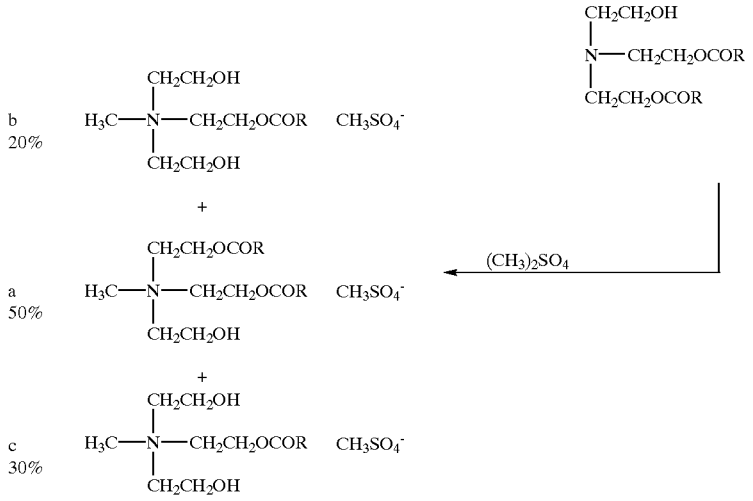

In the present specification, the product mixture of to the above reaction is referred to as "esterquat". It is commercially available from, e.g., Kao Corp. as Tetranyl AT1-75™.

EXAMPLE 1

The preparation of a softening composition of the invention is described below:

Materials

1. Variable Speed Mixer with 4 bladed paddles (diameter is 4 in.~10.2 cm). (Tekmar RW 20 DZM)
2. 4000 ml glass beaker (diameter is 6 in.~15.2 cm)
3. 600 ml glass beaker.
4. Heated magnetic stirring plate with magnetic stirring bar.
5. Scale capable of reading 5-kg+/−0.01 g.
6. Ester Quat (Tetranyl AT 7590, Quaternized Triethanolamine Diester-90%)
7. Synperonic(C13–C15 EO 20)
8. Amino trimethyl phosphonic acid (Dequest 2000)
12. Lactic/Lactate Buffer Solution 80%
13. Encapsulated fragrance slurry (Euracli or Reed Pacific, about 30% Fragrance)
14. Polyacrylate thickener/in mineral oil (50%)
15. Deionized Water
16. Ice Method of Softener Preparation Method A 1. Heat the deionized water to 65° C., add to 4000 ml beaker.
2. Add Dequest 2000 and Synperonic(C13–C15 EO 20) to water while variable speed mixer is on 200 RPM.
3. Heat Ester Quat to 65° C. in 600-mI beaker on magnetic stirring plate with stirring.
4. Shake the Encapsulated fragrance slurry and then add it to Ester Quat and stir for 1 minute.
5. With stirring from the variable speed mixer (400 RPM), SLOWLY (at about 130 g per 3–5 min., which is 25 to 40 g/min.) add the Ester quat//Encapsulated fragrance slurry blend at 60° C. to the deionized water.
6. Mix for 10 minutes.
7. Cool the resulting mixture in an ice/water bath with continuous mixing.
8. After solution reaches 35° C. add Lactic/Lactate Buffer Solution.
9. Add Polyacrylate thick./in mineral oil (50% active), slowly at (400-RPM)
10. Continue mixing for an additional 10 minutes (at 300 RPM) to form the softener composition.

Typical Fabric Softener Formulation:

TABLE 1

| Ingredients | % |
|---|---|
| Di-tallow ester Quaternary ammonium methylsulfate (Tetranyl AT2-75 from Kao) | 8.000 wt % |
| Dequest 2000 | 0.100 |
| Lactic/lactate buffer | 0.063 |
| Polyacrylate thick./in mineral oil (50% active) | 0.3 |
| Synperonic(C13–C15 EO 20) | 0.300 |
| $CaCl_2$ (10%) | 0.010 |
| Encapsulated fragrance slurry* (Euracli or Reed Pacific, 30% Fragrance) | 3.23 |
| Deionized water | balance |

*Encapsulated fragrance slurry composition comprises:
18% free fragrance
12% encapsulated fragrance
8% encapsulating shell material
62% water The physical characteristics of the fabric softener sample are as follows:

| VISCOSITY | pH | CONDUCTIVITY | DENSITY |
|---|---|---|---|
| 200 cP +/− 50 cP | 2.8 +/− 0.2 | 700 μS +/− 50 μS | 0.997 g/ml |

INTRODUCTION TO WORKING EXAMPLES 2 AND 3

The performance of the capsules on dry towels was assessed by two fragrance evaluation panels. The first panel, the Small Fragrance Panel, had up to ten evaluators and were not pre-screened for their ability for fragrance discrimination. They represent so-called average consumers. The members of the second panel, the Fragrance Intensity Discriminating Panel, were selected for their above average ability to discriminate fragrance.

Small Fragrance Panel

The objective of this panel was to determine which one of the two samples has higher fragrance intensity on dry towels.

The panelists evaluated the fragrance of products on one dry terry towel, taken from within a glass container. Each panelist holds a terry towel folded in half with the fold facing away from the body. For the rubbing experiment the panelists grasp a side of the towel with each hand and rub 8 times back-and-forth vigorously. The panelist then sniffs the portion of the towel that has been rubbed. Only a 3-digit code number identifies samples.

After evaluation of the towel, it is placed in a plastic bag and removed. One towel for each product is evaluated by each panelist.

Fragrance Intensity Discriminating Panel.

The objective of this panel was to assess the relative Intensity of fragrance deposited by various softeners on dry towels. The study was implemented as a double-blind, sequential monadic evaluation, counter balanced for initial presentation of each test product. Each panelist evaluates towels washed in test products, dried and left hanging for 1, 3 and 7 days in a controlled environment. Subjects complete sequential monadic ratings on each product in a fragrance booth and rate the intensity of the odor on a 7-point scale: 1. no odor; 2. just detectable; 3. weak; 4. moderate; 5. slightly strong; 6. intense; and 7. very intense.

The panelists evaluate the fragrance of products on one dry terry towel, taken from within a glass container within a fragrance booth. Gloves are always worn when handling sample towels. For the rubbing experiment each panelist holds a terry towel folded in half with the fold facing away from the body. The panelists grasp a side of the towel with each hand and rub 8 times back-and-forth vigorously. The panelist then sniffs the portion of the towel that has been rubbed. Ventilation is on in the booth. Only a 3-digit code number identifies samples.

After evaluation of the towel, it is placed in a plastic bag and removed from the booth. One towel for each product is evaluated by each panelist in the appropriate booth in the order prescribed by the randomization schedule.

EXAMPLE 2

Improved Deposition of Capsules when used in a Fabric Softener Composition

The purpose of this example was to determine the deposition benefit of using a fabric care composition containing a cationic fabric softener as a carrier for the capsules on the fabric, when used in the rinse cycle of washing machine. The following compositions were prepared as shown in Table 2. Sample 1 is a comparative composition, while Sample 2 is a composition of the invention.

TABLE 2

| Ingredients % | Comparative Sample 1 | Sample 2 |
|---|---|---|
| Di-tallow ester Quaternary ammonium methylsulfate (Tetranyl AT2-75 from Kao) | — | 8.000 wt % |
| Deguest 2000 | — | 0.100 |
| Lactic/lactate buffer | — | 0.063 |
| Synperonic(C13–C15 EO 20) | — | 0.300 |
| $CaCl_2$ (10%) | — | 0.010 |
| Encapsulated fragrance slurry* (Euracli, 30% Fragrance) | 3.23 | 3.23 |
| Deionized water | balance | balance |

*Encapsulated fragrance slurry composition comprises:
12% is encapsulated fragrance, 18% is non-confined fragrance
8% encapsulating shell material
62% water For all Sample evaluations 30 new hand Terry towels (86% Cotton, 14% Polyester) were prepared in a 17 gallon top loading washing machine set for hot wash (120 F.), with extra large setting, in tap water. Two wash cycles with 100 g of a commercial liquid detergent were used for all washes. After all wash cycles were over, the towels were dryer dried in an electric clothes dryer, and laid flat for storage.

The swatches for the performance evaluations were cut out of the Terry towels into 60-g swatches. The swatches were then treated in a custom made mini-cycle softening machine, which comprised a Plexiglas cylinder having three separate compartments with two baffles. Each compartment had a volume of three liters. The softening machine was designed for the treatment of small amounts of fabric under simulated home-wash conditions. A 1.8-g of Sample 1 or Sample 2 in 1 liter of tap water was treated in the mini-cycle softening machine for 5 minutes. Swatches were then spun-dried in Miele spinner for 20 seconds. Three replicates were made. Swatches were line-dried in a constant temperature and constant humidity room.

After spinning the swatches were compared first wet by the Small Fragrance Panel to determine which set of towels had more intense fragrance. The panel evaluation was conducted in a constant temperature and constant humidity room.

TABLE 3

| | Sample 1 vs Sample 2 Wet Towels (4 panelists) | | Sample 1 vs Sample 2 Line Dry Towels (6 panelists) | |
|---|---|---|---|---|
| Terry Towels | Sample 1 | Sample 2 | Sample 1 | Sample 2 |
| Number of Votes for Most Intense Fragrance | 0 | 4 | 0 | 6 |
| Winner | Sample 2 | | Sample 2 | |

As shown in Table 3, the swatches treated with Sample 2 were chosen by all members of the panel to have more intense fragrance than those washed in the comparative composition (Sample 1).

EXAMPLE 3

Enhanced Deposition of Capsules by Addition of Cationic, Water Swellable Polymer (polymer of WO-90112862 ex Honeywill & Stein) to the Fabric Softener The purpose of this experiment was to demonstrate that the addition of cationic polymer thickener as herein described to the fabric softener composition further enhances the deposition of capsules. The polymeric thickener was a cross-linked cationic polymer of the type described in WO-90/12862 and purchased from Honeywill and Stein of the U.K.

Fabric softening compositions were formulated as shown in Table 4. Samples 3 and 5 were comparative compositions, while Samples 4 and 6 were the fabric care composition of the invention. Samples 3 and 4 contained aminoplast capsules prepared by Euracli Company of France, while Samples 5 and 6 contained aminoplast capsules prepared by Reed Pacific Company of Australia.

TABLE 4

| Ingredients % | Comparative Sample 3 | Sample 4 | Comparative Sample 5 | Sample 6 |
|---|---|---|---|---|
| Di-tallow ester Quaternary ammonium methylsulfate (Tetranyl AT2-75 from Kao) | 8.000 wt % | 8.000 wt % | 8.000 wt % | 8.000 wt % |

TABLE 4-continued

| Ingredients % | Comparative Sample 3 | Sample 4 | Comparative Sample 5 | Sample 6 |
|---|---|---|---|---|
| Deguest 2000 | 0.100 | 0.100 | 0.100 | 0.100 |
| Lactic/lactate buffer | 0.063 | 0.063 | 0.063 | 0.063 |
| Polyacrylate thick./in mineral oil (50% active) | — | 0.3 | — | 0.3 |
| Synperonic (C13–C15 EO 20) | 0.300 | 0.300 | 0.300 | 0.300 |
| $CaCl_2$ (10%) | 0.010 | 0.010 | 0.010 | 0.010 |
| Encapsulated fragrance slurry (Euracli, 30% Fragrance) | 3.23 | 3.23 | — | — |
| Encapsulated fragrance slurry* (Reed Pacific, 27% Fragrance) | — | — | 3.65 | 3.65 |
| Deionized water | balance | balance | balance | balance |

*Encapsulated fragrance slurry composition comprises:
30% of total fragrance, about 12% of fragrance is in capsules, about 18% is non-confined fragrance;
8% encapsulating shell material;
62% water For all Samples evaluations 30 new hand Terry towels (86% Cotton, 14% Polyester) were prepared in a 17 gallon top loading washing machine set for hot wash (120 F.), with extra large setting, in tap water. Two wash cycles with 100 g Tide free liquid detergent, one wash with water only, extra rinse switch was on, was used for all washes. After all three wash cycles were over, the towels were dryer dried in an electric clothes dryer, and laid flat for storage. All fabric ballast used for the tests was processed the same way as towels between each use.

Twelve hand Terry towels per sample were then washed with 5-lb. ballast load. The loads were washed with 92 g of a U.S. commercial HDL (unfragranced) under US conditions in US Whirlpool (57L top loading washing machine set on large setting, 100 ppm water hardness, 95 F., cold rinse). 100 g of Fabric softeners prepared in Sample 3,4,5 and 6 were then added to the rinse cycle for a two-minute rinse. The wash/rinse cycle was repeated three times for each sample. The loads were then dryer-dried for 60 minutes on medium setting, and aged on-line for a day in a 40% relative humidity chamber. After aging, the Samples were compared for fragrance intensity by a Small Fragrance Panel. The results are shown in Table 4.

TABLE 5

| | Sample 3 vs Sample 4 (5 panelists) | | Sample 5 vs Sample 6 (6 panelists) | |
|---|---|---|---|---|
| Terry Towels | Sample 3 | Sample 4 | Sample 5 | Sample 6 |
| Number of Votes for Most Intense Fragrance | 0 | 5 | 0 | 6 |
| Winner | Sample 4 | | Sample 6 | |

As shown in Table 5, the towels rinsed with Sample 4 or 6 were chosen by members of the panel to have more intense fragrance than those washed in comparative composition (Sample 3 and 5). The result of the fragrance panel evaluation clearly demonstrates that the capsules incorporated in the cationic fabric softener containing a cationic, water swellable polymer as a carrier significantly increased the amount of deposited fragrance on the fabric.

Additional evaluations were performed with additional sets of towels washed under the wash conditions described above, washed with the Fabric softener Samples 3,4,5 and 6. However, for this evaluations the towels were cut in half and the panelists were instructed to compare the intensity of fragrance on one half of the towel as is vs. the fragrance intensity on the other half of the towel, which was rubbed eight times prior the evaluation. The results of the Small Fragrance Panel are summarized in Table 6 below.

TABLE 6

| | Sample 3 (5 panelists) | | Sample 4 (5 panelists) | | Sample 5 (6 panelists) | | Sample 6 (6 panelists) | |
|---|---|---|---|---|---|---|---|---|
| Terry Towels | As is | Rub | As is | Rub | As is | Rub | As is | Rub |
| Number of Votes for Most Intense Fragrance with and w/o rubbing the Terry towels | 0 | 5 | 0 | 5 | 0 | 6 | 0 | 6 |
| Winner | Rubbed 3 | | Rubbed 4 | | Rubbed 5 | | Rubbed 6 | |

The results of the test demonstrate that capsules deposit well on fabric when delivered from either of the Sample formulas 3 through 6, and that the capsules ruptured and released fragrance upon gentle rubbing.

What is claimed is:

1. A stable fabric softening composition comprising:

(a) a cationic softening compound;

(b) a non-confined fragrance oil;

(c) at least one fabric or skin beneficiating ingredient free of any water-insoluble polymer or non-polymeric carrier material which allows diffusion of said fabric or skin beneficiating ingredient therethrough and which beneficiating ingredient is contained within friable microcapsules comprising an aminoplast polymeric shell, said microcapsules having a diameter of from about 0.1 to about 350 microns, with the proviso that when said beneficiating ingredient is a fragrance oil, said fabric softening composition is prepared by a process comprising the step of adding sequentially or in combination (i) said non-confined fragrance oil of (b); and (ii) the encapsulated fragrance oil of (c) to said cationic softening compound and wherein said non-confined fragrance oil and said encapsulated fragrance oil are not mixed with any suspending agent prior to their addition to said cationic softening compound in accordance with said process; (d) a nonionic or cationic polymer other than said aminoplast polymer to enhance the deposition and substantivity of said fabric or skin beneficiating ingredient on said fabric surface; and (e) balance water and optionally one or more adjuvant materials whereby the ordinary manipulation of fabric during wearing or handling is capable of rupturing the polymeric shell of said microcapsules which are deposited on the fabric surface during treatment with said fabric softening composition to release said fabric or skin beneficiating ingredient.

2. A fabric softening composition in accordance with claim 1 wherein the cationic softening compound is selected from the group consisting of:

(a) dialkyl quaternary ammonium compounds;

(b) dialkyl fatty ester quaternary ammonium compounds; and (c) alkyl imidazolinium compounds.

3. A fabric softening composition in accordance with claim 1 which is the form of a liquid, powder or gel.

4. A fabric softening composition in accordance with claim 1 which is in the form of a fabric softener sheet.

5. A fabric softening composition in accordance with claim 1 wherein the fabric or skin beneficiating ingredient is selected from the group consisting of perfumes or fragrance oils, anti-bacterial agents, vitamins, skin conditioners, UV absorbers and enzymes.

6. A fabric softening composition in accordance with claim 1 wherein said cationic polymer is a cross-linked polymer is derived from the polymerization of from 5 to 100 mole percent of a cationic vinyl addition monomer, from 0 to 95 mole percent of acrylamide and from 70 to 250 ppm of a difunctional vinyl addition monomer.

7. A fabric softening composition in accordance with claim 6 wherein said cationic polymer is a cross-linked copolymer of a quaternary ammonium acrylate or methacrylate in combination with an acrylamide co-monomer.

8. A method of imparting softness to fabrics comprising contacting said fabrics with an effective amount of the fabric softening composition of claim 1.

9. The method of claim 8 wherein said fabrics are contacted during the rinse cycle of an automatic laundry washing machine.

* * * * *